US010325698B2

(12) United States Patent
Koeppendoerfer et al.

(10) Patent No.: US 10,325,698 B2
(45) Date of Patent: Jun. 18, 2019

(54) ELECTRIC CABLE

(71) Applicant: LEONI KABEL GMBH, Nuremberg (DE)

(72) Inventors: Erwin Koeppendoerfer, Schwabach (DE); Rainer Poehmerer, Winkelhaid (DE)

(73) Assignee: LEONI Kabel GmbH, Nuremberg (DE)

( * ) Notice: Subject to any disclaimer, the term of this patent is extended or adjusted under 35 U.S.C. 154(b) by 0 days.

(21) Appl. No.: 15/954,648

(22) Filed: Apr. 17, 2018

(65) Prior Publication Data

US 2018/0233254 A1 Aug. 16, 2018

Related U.S. Application Data

(63) Continuation of application No. PCT/EP2016/075999, filed on Oct. 27, 2016.

(30) Foreign Application Priority Data

Oct. 28, 2015 (DE) ..... 10 2015 221 108

(51) Int. Cl.

| | |
|---|---|
| ***H01B 11/10*** | (2006.01) |
| ***H01B 11/18*** | (2006.01) |
| ***H01B 11/00*** | (2006.01) |
| ***H01B 7/02*** | (2006.01) |
| ***H01B 7/18*** | (2006.01) |
| *H01B 7/17* | (2006.01) |

(52) U.S. Cl.

CPC ..... *H01B 11/10* (2013.01); *H01B 7/0275* (2013.01); *H01B 7/1875* (2013.01); *H01B 11/002* (2013.01); *H01B 11/1066* (2013.01); *H01B 11/1895* (2013.01); *H01B 7/17* (2013.01)

(58) Field of Classification Search

CPC .. H01B 11/10; H01B 7/0275; H01B 11/1895; H01B 11/002

USPC ..... 174/74 R

See application file for complete search history.

(56) References Cited

U.S. PATENT DOCUMENTS

| | | | | |
|---|---|---|---|---|
| 4,926,008 | A * | 5/1990 | Shreeve | H01B 7/009 174/117 FF |
| 5,208,426 | A * | 5/1993 | Kennedy | H01B 11/1066 174/102 SC |
| 2010/0296276 | A1* | 11/2010 | Bieri | H02S 40/44 362/184 |
| 2015/0253268 | A1* | 9/2015 | Girlando | G01N 27/00 324/71.1 |
| 2015/0355430 | A1* | 12/2015 | Clampitt | G02B 6/4432 385/103 |

(Continued)

FOREIGN PATENT DOCUMENTS

| | | | |
|---|---|---|---|
| WO | 2013159824 | A1 | 10/2013 |
| WO | WO 2013/159824 | A1 * | 10/2013 |

*Primary Examiner* — Timothy J Thompson
*Assistant Examiner* — Charles Pizzuto
(74) *Attorney, Agent, or Firm* — Laurence A. Greenberg; Werner H. Stemer; Ralph E. Locher

(57) ABSTRACT

An electric cable, in particular a data cable, has a transmission core which is surrounded by a shield and concentrically surrounded by a sheath that includes an outer layer made of an electrically insulating plastic material and a second layer underneath that is made of a semiconducting material. The semiconducting material primary purpose is to divert interference currents.

17 Claims, 2 Drawing Sheets

(56) References Cited

U.S. PATENT DOCUMENTS

| | | | | |
|---|---|---|---|---|
| 2016/0248187 | A1* | 8/2016 | Szyszko | H01R 13/506 |
| 2017/0133125 | A1* | 5/2017 | Janssen | H01B 11/002 |

* cited by examiner

ELECTRIC CABLE

CROSS-REFERENCE TO RELATED APPLICATION

This is a continuation application, under 35 U.S.C. § 120, of copending international application No. PCT/EP2016/075999, filed Oct. 27, 2016, which designated the United States; this application also claims the priority, under 35 U.S.C. § 119, of German patent application No. DE 10 2015 221 108.8, filed Oct. 28, 2015; the prior applications are herewith incorporated by reference in their entirety.

BACKGROUND OF THE INVENTION

Field of the Invention

The invention relates to an electric cable in particular a data cable having a transmission core that is surrounded by a shielding arrangement, wherein the transmission core is surrounded in a concentric manner by a conductive sheath.

Electric cables frequently contain a shielding arrangement. Data cables in particular use this shielding arrangement so are to provide a shield against external interference influences on the signal transmission within the transmission core. A shielding arrangement of this type is also used simultaneously to provide a shield with respect to the outside with the result that interference fields do not pass from the transmission core into the environment. Shielding arrangements of this type are in particular also necessary in the case of cables for transmitting power, in particular by way of example high voltage cables.

The shielding arrangement is regularly configured as an electrically conductive element that surrounds the cable core. Numerous shield variations are available, such as by way of example foil shields, braid shields (C-shields) or spiral shields (D-shields) or combinations thereof. In order for the shielding arrangement to be effective, it is necessary that the shielding arrangement is highly conductive and thus is in electrical contact with a reference potential, by way of example ground potential, in a connection region where the electric cable is connected to an electrical component such as by way of example a plug connector or also an electrical device. This is associated with an increase outlay during the assembly process. A shield that does not contact the reference potential or does not contact the reference potential in an optimum manner only demonstrates a poor shielding effect or even causes additional interference influences in comparison to an unshielded cable.

In the case of cables that are frequently exposed to reverse bending stresses, it is furthermore necessary to select a compromise between a good shielding effect and a low level of rigidity.

In the case of data cables, in addition to shielded cables so-called unshielded data cables are also known. Twisted core pairs without a shielding arrangement are frequently provided for this purpose, said twisted pair cores being used for a symmetrical data transmission (so-called unshielded twisted pair, UTP). Unshielded data cables of this type are used in particular in the case of low-cost applications by way of example also in the automotive industry and in such applications that do not pose any excessively high requirements on the quality of the data transmission and in particular on the speed (frequency of the transmitted data signals).

Symmetrical data cables are frequently used for a symmetrical data transmission. In this case, a signal is transmitted via a first core and the inverted signal is transmitted via a second core and the two signals are evaluated jointly. Two cores form a respective core pair for a symmetrical data transmission.

The demand for data transmission systems in particular for single pair data cables without a shield layer will increase in the future. As a result of the limitation, for example to one pair, and omitting the shielding arrangement, both installation space and also weight and cable costs will be reduced. The same applies in a similar manner also for the plug connector and the assembly process. Such transmission systems are in particular in demand in the automotive industry since in that industry the installation space is limited and as a result of reducing the weight it may be possible both to improve the driving behavior and also to reduce the fuel or energy required during the driving operation.

However, a multiplicity of cables lie packed closely directly adjacent to one another in a cable duct or in a vehicle electrical supply. The small spaces render it possible for an interference signal to couple over from one cable (aggressor/transmitter) to the other cable (victim/receiver) (so-called third-party cross-talk).

SUMMARY OF THE INVENTION

On this basis, the object of the invention is to provide an electric cable that contains a shielding arrangement and is cost-effective to produce and at the same time achieves an improved shielding effect in comparison to the conventional cables.

The object is achieved in accordance with the invention by an electric cable having the features of the main independent claim. The electric cable contains a transmission core that is surrounded by a shielding arrangement. The transmission core overall is surrounded in a concentric manner by a cable sheath. The cable sheath itself is configured in two layers and contains an outer layer of an electrically insulating synthetic material and a second layer of a semi-conductive material that lies below the said outer layer.

This embodiment is based fundamentally on the consideration that interference currents that are caused by external interference fields are diverted in the longitudinal direction of cable via the shielding arrangement. In order to realize an effective shielding effect, it is necessary to provide in a conventional manner a reliable discharge of the interference currents and in particular to provide a good contact between the shield and the reference potential, by way of example the ground potential, in the region of the connection (plug connector or device).

The particular advantage of the proposed measure with the second layer of a semi-conductive material resides in the fact that in lieu of diverting the interference currents in this manner, the interference currents are damped at least in part at an early stage within the second layer as a result of the layer having a low level of conductivity. The energy of the interference currents is therefore at least in part and preferably completely consumed in the second layer. This therefore forms in this respect a "sump" for interference fields, in particular for external HF interference fields.

In addition, the external, conventional insulating layer is used so as to provide insulation with respect to the environment.

As a result of the second semi-conductive layer, the effectiveness of the shield is improved overall in comparison to conventional unshielded cables. Simultaneously, a second layer of this type of a semi-conductive material is cost-effective and applied in a simple manner.

In particular, the second layer is applied by an extrusion process, in particular by means of tube extrusion, onto the transmission core or also onto a shield layer that surrounds the core.

Furthermore, the semi-conductive sheath has a wall thickness that is in particular constant around the circumference of the transmission core. The wall thickness is expediently in the range between 0.05 mm to 1.2 mm and in particular in the range from 0.1 mm to 0.3 mm. In particular a wall thickness of 0.2 mm is selected in the case of a by way of example extruded semi-conductive sheath.

The semi-conductive sheath contains as an alternative or in addition to the extruded sheath a foil, which is provided in particular in the form of a band and/or non-woven material and/or individual wires that are provided in particular as a type of winding and are correspondingly less conductive. If a foil or also a non-woven material is used, the wall thickness is typically slightly less than the previously mentioned 0.2 mm. In the case of a foil, by way of example a suitably slitted foil, in particular a metal-coated synthetic material foil is used. The low level of conductivity is realized by the slits.

Furthermore, it is preferred that the outer layer of the insulating synthetic material is also applied by an extrusion process. The two layers are applied in particular by a co-extrusion process.

As an alternative to extruding the second layer, the second layer is applied by way of example by a banding process. In each case, the cable sheath and also the second layer extend continuously over the entire length of the cable.

The outer layer is in particular an outer sheath of the electric cable that is not surrounded in a concentric manner by a further sheath.

Multiple electric cables of this type may be combined to form one cable or a cable bundle.

The transmission core is generally an electric transmission core, which is preferably configured so as to transmit date or alternatively so as to transmit electrical power.

The term 'semi-conductive material' is generally understood to mean a material that is considerably less conductive than metals, as is the case in conventional shield layers. In particular, the conductivity is less by at least the factor 10, preferably by at least the factor 100 or also 1000 up to the factor $10^6$ than the conductivity of pure copper (in each case at 20° C.).

In accordance with a preferred embodiment, the cable sheath comprises below the second layer, in other words in the direction towards the transmission core, a conductive layer that lies against the second layer in such a manner as to make electrical contact.

This embodiment relates to the consideration that it is possible in particular in the case of higher frequency interference fields for the interference fields to penetrate the cable sheath and also the second layer and that the interference fields are therefore only damped in part in the second layer. These portions of the interference fields impinge on the conductive layer and generate interference currents in the conductive layer. As a result of the skin effect, the interference currents extend on the outer face of the conductive layer and pass back into the second layer where they are further damped. Overall, as a result the energy that is introduced via the interference fields is completely consumed to the greatest extent in the second layer.

This conductive layer is configured in an expedient manner as a foil that is cost-effective to produce and to apply. Insofar as the term 'conductive layer' is discussed, this term is generally understood to mean conductivity in the range of that of metals. The conductive foil is typically a conventional shield foil that is configured frequently as a metal-coated synthetic material foil, in particular an aluminum-coated synthetic material foil or also as copper foil. The aluminum layer may be applied to one side or also to both sides of the carrier foil. The total thickness of a foil of this type is typically in the range between 20 up to 100 μm, wherein the thickness of the at least one metal layer is at least approximately 7 m or at least 10 μm and by way of example up to 30 or also up to 50 μm. Such comparatively thin metal layers in the range from 7 to 20 μm are sufficient for the desired application case described here.

In accordance with a preferred embodiment, a further shield layer is not provided in addition to the cable sheath, in other words in particular in addition to the second layer and the conductive layer. An electric cable of this type therefore contains a transmission core, a foil as a conductive layer that where necessary surrounds the transmission core, the second layer of a semi-conductive material and the outer insulating layer.

A cable of this type is used in particular in lieu of hitherto unshielded data cables, by way of example unshielded twisted pair data cables (UTP cables). A considerable improvement in the data transmission is realized by the shielding effect of the second layer of a semi-conductive material that is applied by an extrusion process, and by the associated damping of undesired interference currents.

By virtue of damping the interference currents in the second layer, the interference energy that is introduced is preferably consumed within the second layer. In general, in addition the particular advantage is realized that in order to realize the desired shielding effect—in contrast to conventional shields—it is not necessary to contact the shielding arrangement in the connection region.

In an expedient embodiment, even in the assembled state, if an electrical component is therefore connected at one end to an end of the electric cable, the shielding arrangement is not contacted in an electric manner, in other words by way of example is connected to a ground potential. The shielding arrangement is formed in this case by the second layer, where necessary in combination with the conductive layer that is lying below said layer. This has the decisive advantage that the assembly outlay is less and that in particular conventional (connection) components are used that are also used for conventional unshielded cables. All process steps, components, such as plug connectors etc. may remain unchanged (in comparison to hitherto unshielded cables) whilst simultaneously considerably improving the shielding effect.

The components are contact plug connectors or also however directly consumers that are fixedly connected directly to the cable. In general, therefore in the case of this particular embodiment variant a shielded contact arrangement is not provided in the region of the components and consequently a specific connection concept for the shielding arrangement is omitted.

The data cables are in particular symmetrical data cables having at least one core pair by which a symmetrical signal is transmitted during operation. In this case, the core pair is in particular a twisted core pair. In addition, alternatively quad stranding arrangements, such as by way of example the so-called star quad stranded formation, are used as the transmission core.

As an alternative to this low-cost application without a shielded contact arrangement, the cable sheath having the semi-conductive second layer is used in the case of conventional, shielded cables, in particular in the case of coaxial cables. Particularly in this case, the transmission core is surrounded at least by one shield layer around and in turn the cable sheath is provided around the shield layer, in particular by an extrusion process. This shield layer is connected in the assembled state in particular via a shielded contact arrangement in the region of the components and connected to the reference potential. A shield layer of this type forms in particular an outer conductor of a coaxial cable.

The shield layer is a conventional, also multi-layer shield layer that is configured by way of example as a shield braid (C-shield) as a shield that is formed by wire windings (D-shield or helical shield). In addition, foil shields or a combination of these shield types are used for a multi-layer construction.

Even in the case of a conventional shielded cable of this type, an improved shielding effect is realized with the particular cable sheath construction having the semi-conductive second layer by virtue of damping the interference currents in the second layer. Also in this case the previously described effect is exploited that interference currents are dissipated as a result of the higher frequency fields and by means of the skin effect on the outer face of the shield layer and as a consequence are damped by the second layer.

In the case of the first variant having the transmission core that contains one or multiple core pairs without a specific shield layer (that in the assembled state is connected to the reference potential), the shielding arrangement of the cable is formed exclusively by means of the cable sheath, namely exclusively by the second semi-conductive layer or where necessary also in cooperation with the conductive layer. In the case of the second variant having the additional shield layer, the (entire) shielding arrangement is formed by the second layer of the conductor sheath (where necessary having the additional conductive layer) in combination with the shield layer.

The specific resistance of the semi-conductive material is generally preferably greater than 1 Ohm*mm$^2$/m and preferably greater than 10 Ohm*mm$^2$/m. The specific resistance is typically at least two powers of ten greater by way of example in comparison to the specific resistance of copper (in relation to an ambient temperature of 20° C.). Furthermore, the specific resistance is preferably less than 1000 Ohm*mm$^2$/m and in particular less than 100 Ohm*mm$^2$/m. Consequently, the specific resistance is considerably less than the resistances of typical insulating materials. In particular, the specific resistance is therefore in the range between 10 to 100 Ohm*mm$^2$/m. As a consequence, an efficient damping process is ensured.

The semi-conductive material is by way of example a conductive material, in other words a synthetic material that is intrinsically conductive.

As an alternative thereto, the low conductivity is formed by an insulating synthetic material that comprises embedded conductive particles. The particles are in particular carbon particles or soot particles, or also carbon nanoparticles. This is understood to be so-called nanoflakes or also nanotubes. The desired conductivity is realized by the carbon particles. The proportion of particles is selected such that the above desired conductivity or rather the desired specific resistance is set. Depending upon the particles and upon the desired specific resistance, the filling level of the particles is by way of example in the range between 8 and 55 vol % and in particular in the range between 10 and 40 vol % in relation to the total volume of the second semi-conductive layer.

It is preferred that metal particles and/or magnetic, in particular ferromagnetic or magnetizable, particles are not used for the semi-conductive material. Such comparatively hard metal particles would result in tool wear during the extrusion process. The particles are omitted for this reason.

In a first variant, the semi-conductive second layer is arranged directly around the transmission core that is formed by the cores. The semi-conductive second layer is configured in particular as a type of tube (that is applied by means of an extrusion process).

In a preferred alternative, an intermediate sheath is arranged between the transmission core, which preferably comprises precisely one core pair or also multiple core pairs, and the semi-conductive sheath, with the result that there is a (minimum) spacing between the semi-conductive sheath and the core pair. The spacing is preferably at least approximately 0.5 mm and in particular a maximum 1.5 mm. The term 'spacing' is understood to mean the smallest distance to a respective core.

The intermediate sheath itself is configured in an expedient manner from an in particular solid insulating material, such as by way of example polypropylene. The intermediate sheath therefore forms a suitable dielectric which has a positive effect on the transmission of the in particular symmetrical signals.

The data cable is surrounded on the outer face by a further outer sheath of an insulating material. This may be a solid sheath or also a foamed sheath. It is also possible to provide spacing elements with the result that mutually adjacent data cables are held at a defined spacing with respect to one another.

A data cable of this type therefore contains overall preferably a (single) core pair, wherein the core pair is formed by two cores, containing a conductor, in particular a stranded conductor of mutually twisted individual strands of a conductive material, in particular copper, a copper alloy or also aluminum, an aluminum alloy etc. The conductor is surrounded by a core insulation. The conductor typically contains a diameter in the range from 0.3 mm to a maximum 1.2 mm, preferable in a range from 0.3 mm to 0.9 mm. The diameter of the core is typically in the range between 0.7 mm to 2.5 mm. The two cores are twisted with one another and surrounded by the intermediate sheath. This contains typically a diameter that corresponds to twice the core diameter plus in addition the minimum wall thickness of the intermediate sheath of preferably 0.5 mm.

In the case of the small conductor diameters (0.3 mm) and corresponding small core diameters (0.7 mm), the diameter of the intermediate sheath is therefore approximately 2.4 mm. This is subsequently surrounded by the semi-conductive sheath that comprises a wall thickness of approximately 0.2 mm with the result that an outer diameter of this semi-conductive sheath is preferably 3 mm. Finally, this is also surrounded by an outer sheath that contains in turn a wall thickness of by way of example 0.5 mm to 1.5 mm.

As already mentioned, the cable in accordance with a first embodiment variant is a symmetrical data cable, in which the data transmission core is formed by at least one core pair for transmitting a symmetrical data signal. The transmission core is preferably formed by at least one twisted pair or also by multiple twisted pairs or also a quad stranding arrangement. In accordance with a first embodiment variant, a respective pair may be surrounded by a pair shielding arrangement. As an alternative thereto, a pair shielding arrangement is not provided. It is preferred in the case of this symmetrical data cable that a shielding contact to a component is not provided in the connection region.

As an alternative thereto, the electrical cable is configured as a coaxial cable having an inner conductor, a dielectric of synthetic material that is surrounded by the inner conductor, and an outer conductor that is formed by means of the previously mentioned shield layer. The cable sheath is subsequently applied to the outer conductor, wherein the second layer lies against the shield layer.

Finally, the electrical cable in accordance with a further embodiment variant is configured as a supply line for supplying a consumer with electrical power in the range of by way of example at least several 10 W or 100 W or also in the KW range. The transmission core may comprise multiple power cores having an insulated conductor with a sufficiently large conductor cross-section. The conductor cross-section is by way of example configured for transmitting currents in the ampere range.

Other features which are considered as characteristic for the invention are set forth in the appended claims.

Although the invention is illustrated and described herein as embodied in an electric cable, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
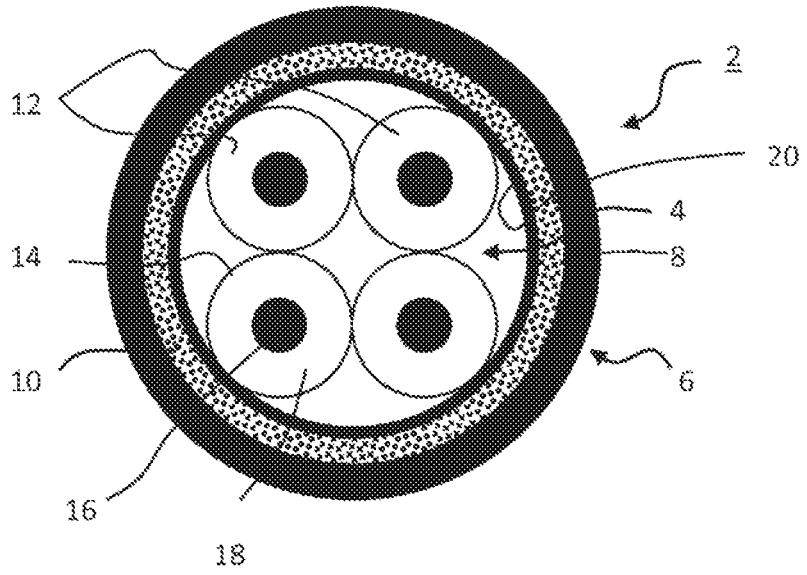
FIG. 1 is a diagrammatic, cross-sectional view of an electric cable in accordance with a first embodiment variant according to the invention.

Like functioning parts are each provided with the like reference numeral in the figures.

Figure 2:
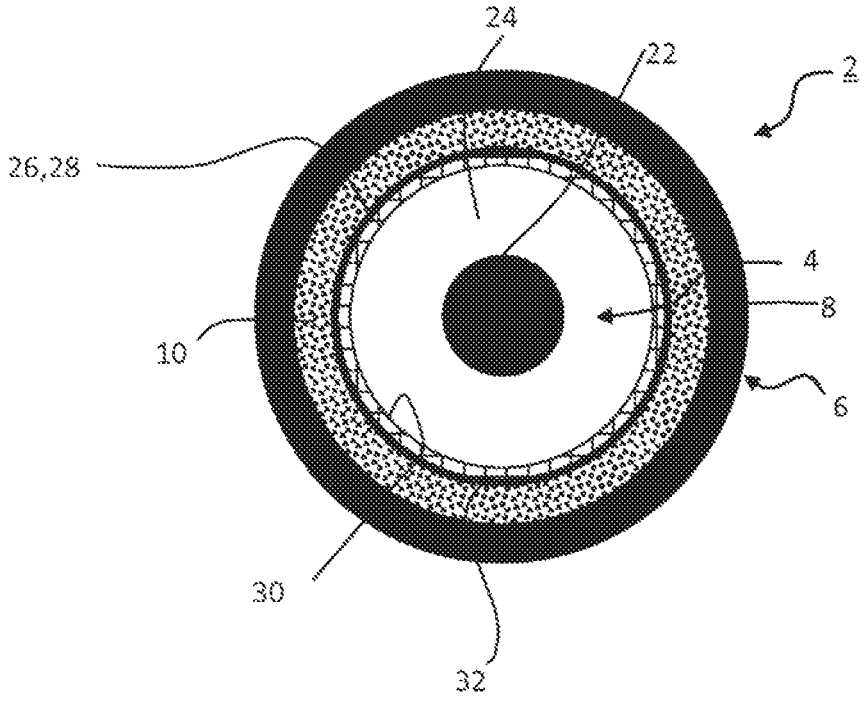
FIG. 2 is a cross-sectional view of the electric cable in accordance with a second embodiment variant.
Figure 3:
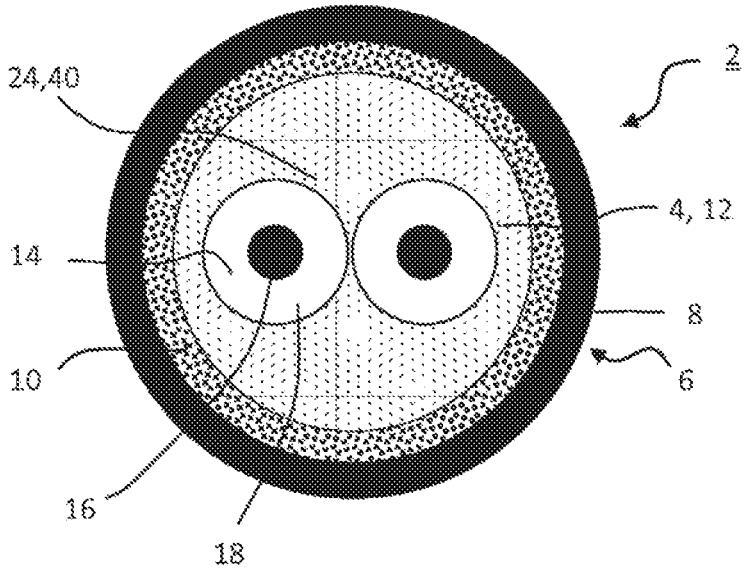
FIG. 3 is a cross-sectional view of the electric cable in accordance with a third embodiment variant having an intermediate sheath.

Referring now to the figures of the drawings in detail and first, particularly to FIGS. 1-3 thereof, there is shown cables 2 that are configured in the exemplary embodiment in each case as data cables and contain a central transmission core 4 that is surrounded by a cable sheath 6. In all variants, the cable sheath 6 contains an outer first layer 8 of an electric insulating synthetic material and also a second layer 10 of a semi-conductive material that is arranged directly below the outer first layer. The cable sheath 6 in the exemplary embodiments illustrated in FIGS. 1 and 2 lies directly against the transmission core 4. The cable sheath 6 is in particular a cable sheath 6 that is provided by an extrusion process. The two layers 8, 10 are provided in particular by a co-extrusion process. The cable sheath 6 is applied to the transmission core 4 as a type of tube extrusion.

The cable 2 in accordance with the embodiment variant illustrated in FIG. 1 is configured as a symmetrical data cable having in the exemplary embodiment preferably 2 core pairs. A respective core pair 12 is used during the data transmission of a symmetrical data signal for transmitting on the one hand the signal and on the other hand the inverted signal. In particular, the respective core pair 12 is a twisted core pair. A respective core 14 is formed by a central conductor 16 that is surrounded by an insulating sheath 18 as a core sheath.

In the case of the embodiment variant in accordance with FIG. 1, the cable sheath 6 contains in addition also a conductive layer 20 that is formed in particular by a foil, in particular a conventional shield foil. This is in particular an aluminum-coated synthetic material foil. The metal face is oriented toward the second layer 10 and contacts the second layer in an electrically conductive manner. The conductive layer 20 is omitted in an alternative variant.

In contrast thereto, in the case of the embodiment variant in accordance with FIG. 2, the cable is a coaxial cable in which the transmission core 4 is formed by an inner conductor 22, a dielectric 24 of insulating synthetic material that directly surrounds the inner conductor and also an outer conductor 26 that lies directly against the dielectric 24. The outer conductor 26 simultaneously defines a shield layer 28. This shield layer 28 contains in the exemplary embodiment a multi-layer construction having a braid 30 and a shield foil 32. The shield foil 32 is preferably arranged on the outer face but it may as an alternative also be arranged on the inner face facing the braid 30. It is also in this case of importance that the shield layer 28 is in electrical contact with the second semi-conductive layer 10. The second semi-conductive layer 10 surrounds the shield layer 28 directly and is in particular configured as a sheath that is applied by an extrusion process.

In the event that external interference fields occur in the high frequency range, in particular in the range from 1 to 5000 MHz, the high frequency interference fields penetrate the cable sheath 6 and pass through the cable sheath. As a result of the conductivity of the second layer 10, the high frequency interference fields are greatly damped in this second layer 10, in other words their energy is at least in part, preferably completely converted into heat in the second layer 10.

In the case of the embodiment variant in accordance with FIG. 1, portions of the external inference field that pass through the second layer 10 impinge on the conductive layer 20, by way of example on the shield layer 28 in the case of the embodiment variant shown in FIG. 2. In the case of said embodiment, interference currents are generated that propagate in the longitudinal direction of the cable 2. As a result of the skin effect, said interference currents dissipate at the outer face of the conductive layer 20 or rather of the shield layer 28 and as a result of the immediate vicinity pass into the second layer 10 where they are further damped.

As a result of the particular construction of the cable sheath 6, a shielding effect is in general improved by the shielding damping process. Any interference fields that are introduced are converted into heat in the second layer 10.

Third-party cross-talk is also avoided as a result. The currents that are impressed in the conductive layer as a result of the electromagnetic coupling cause the electromagnetic field to be attenuated toward the outside and as a consequence cause a reduction in the coupling over into adjacent cables (third party cross-talk).

This applies in particular also for the embodiment variant shown in FIG. 3. The cable 2 contains as a transmission core only one core pair 12 that is in particular twisted and is surrounded directly by an intermediate sheath 40. In this case, the intermediate sheath is a synthetic material sheath that is applied in particular by an extrusion process and forms a dielectric 24.

The intermediate sheath 40 is in turn surrounded directly by the second semi-conductive layer 10 that is finally surrounded by the outer sheath 8. The latter provides the electrical insulation, the protection against environmental influences or also acts as a spacer element. In an alternative variant, it is also possible to provide a conductive layer 20.

In particular in the case of low-cost applications, preferably in the automotive industry, the construction described here having the intermediate sheath 10 is used for the purpose of replacing conventional unshielded cables, in particular data cables, in particular unshielded symmetrical data cables, with a cable 2 (symmetrical data cable) that is provided with a cable sheath 6 of this type. Simultaneously, however, the conventional components for the unshielded data cable and also the conventional process steps are retained. In particular, a shielding contact is not provided in a connection region to a component 34. The respective shield of the cable 2 is therefore not directly connected in an electrical manner to the component 34—as is otherwise usual—to a reference potential, in particular to a ground potential.

Figure 4:
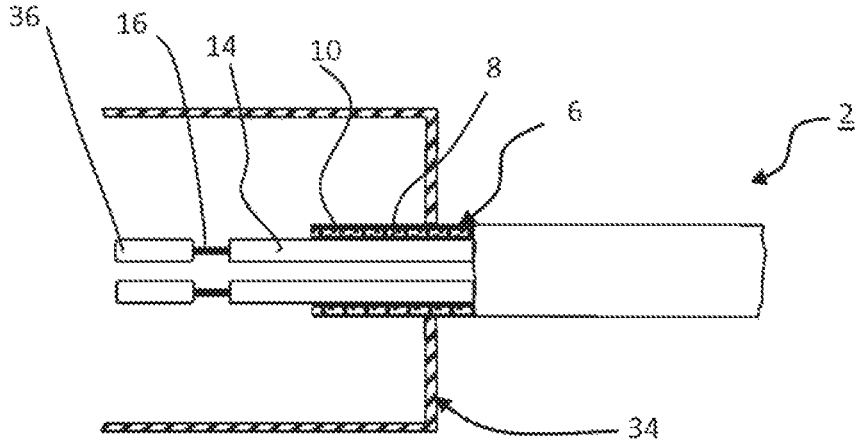
FIG. 4 is an illustration of the electric cable of the first embodiment variant as shown in FIG. 1 in a partial sectional view and connected to a component.

This concept is illustrated in FIG. 4. It is apparent in FIG. 4 that the cable 2 by way of example in accordance with FIG. 1 or FIG. 3 is inserted into the component 34, which is merely greatly simplified in the illustration, through an inlet opening. The cable sheath 6 is by way of example inserted simultaneously through the opening. The opening is usually sealed, by way of example by means of a seal ring, a grommet or by circumferential webs that are pressed into the cable sheath 6. The component 34 is by way of example a plug connector that is used to connect to a consumer. As an alternative thereto, the component 34 is directly a consumer. In both cases, the cable 2 is inserted through the opening of a housing.

The individual cores 14 are not covered by the cable sheath 6 within the component 34 and also the insulation is removed from the respective conductor 16 of the respective core 14 and connected to one end at a contact element 36. These are by way of example contact bushes or contact pins that are configured by way of example as crimp contacts. As an alternative thereto, it is also possible to provide a screw contact arrangement.

The invention claimed is:

1. An electric cable, comprising:

a transmission core having at least one core pair and said at least one core pair having no pair shielding configuration;

a shielding configuration surrounding said transmission core;

a cable sheath surrounding said transmission core in a concentric manner, said cable sheath having a first outer layer of an electrically insulating synthetic material and a second layer of a semi-conductive material disposed below said first outer layer;

an intermediate sheath disposed between said transmission core and said second layer formed of said semi-conductive material so that there is a minimum spacing between said second layer and said transmission core, the minimum spacing being at least 0.5 mm.

2. The electric cable according to claim 1, wherein said second layer is provided together with said first outer layer by means of a co-extrusion process.

3. The electric cable according claim 1, wherein said second layer of said semi-conductive material has a wall thickness in a range from 0.05 to 1.2 mm.

4. The electric cable according to claim 1, wherein said intermediate sheath is a conductive layer that lies against said second layer in an electrically contacting manner.

5. The electric cable according to claim 4, wherein said conductive layer is configured as a foil.

6. The electric cable according to claim 1, wherein said shielding configuration is formed exclusively by said second layer.

7. The electric cable according to claim 1, wherein the electric cable is connected at at least one end to an electric component, wherein said shielding configuration is not contacted in an electrical manner to the electric component.

8. The electric cable according to claim 1, wherein said semi-conductive material has a specific resistance being greater than 1 Ohm*mm$^2$/m.

9. The electric cable according to claim 8, wherein the specific resistance is less than 1,000 Ohm*mm$^2$/m.

10. The electric cable according to claim 1, wherein said semi-conductive material is a conductive synthetic material.

11. The electric cable according to claim 1, wherein said semi-conductive material is formed by an insulating synthetic material having conductive particles embedded therein.

12. The electric cable according to claim 1, wherein said semi-conductive material does not contain any metal particles and/or does not contain any magnetic particles.

13. The electric cable according to claim 1, wherein:

the electric cable is a data cable; and said transmission core is formed by precisely one said core pair being directly surrounded by said intermediate sheath, said intermediate sheath being applied by means of an extrusion process.

14. The electric cable according to claim 1, wherein the spacing with respect to said transmission core is at least 0.5 mm and at most 1.5 mm.

15. The electric cable according to claim 1, wherein said intermediate sheath is configured from a solid insulating material.

16. The electric cable according to claim 1, wherein:

the electric cable is configured as a symmetrical data cable; and said transmission core is formed for transmitting a symmetrical data signal.

17. The electric cable according to claim 1, wherein said at least one core pair is one of two core pairs without any shielding between said two core pairs.

* * * * *